United States Patent [19]

Hargraves

[11] 4,075,718

[45] Feb. 28, 1978

[54] NOZZLE FLUSH SYSTEM

[76] Inventor: William J. Hargraves, 515 S. Paula Drive, Dunedin, Fla. 33528

[21] Appl. No.: 564,896

[22] Filed: Apr. 3, 1975

[51] Int. Cl.[2] ..... E03D 11/00; E03D 5/10; B67D 5/54

[52] U.S. Cl. ..... 4/300; 4/345; 4/DIG. 3; 137/207; 4/362; 4/434

[58] Field of Search ..... 4/6, 7, 10, 26, 29, 4/52, 65, 67 R, 70, 76, 79, 80, 89, 115, 92, 87, 90, 100, DIG. 3, 249; 137/207; 251/20; 239/567, 568, 597, 598

[56] References Cited

U.S. PATENT DOCUMENTS

| | | | |
|---|---|---|---|
| 1,335,267 | 3/1920 | Ambrose et al. | 239/598 X |
| 2,056,087 | 9/1936 | Andrews | 4/DIG. 3 |
| 3,094,707 | 6/1963 | Fleming | 4/115 X |
| 3,343,560 | 9/1967 | Nankivell | 137/207 |
| 3,621,495 | 11/1971 | Carson | 4/26 X |
| 3,628,195 | 12/1971 | Skousgaard | 4/26 |
| 3,677,294 | 7/1972 | Gibbs et al. | 4/26 X |
| 3,772,711 | 11/1973 | Spector | 4/78 |
| 3,824,632 | 7/1974 | Bach et al. | 4/115 X |
| 3,958,158 | 5/1976 | Dart | 4/DIG. 3 |

*Primary Examiner*—Richard E. Aegerter
*Assistant Examiner*—Stuart S. Levy
*Attorney, Agent, or Firm*—Cushman, Darby & Cushman

[57] ABSTRACT

A plumbing system for flushing a toilet bowl is provided having one or more high pressure nozzles disposed about the rim of the bowl so that the discharge from the nozzles will impinge upon all of the interior surfaces of the bowl; the nozzles are each connected to a common pressure chamber through a flush valve; the pressure chamber contains an air pocket which will be compressed when liquid under main pressure accumulates in the pressure chamber; liquid from a water main is supplied to the pressure chamber through an adjustable flow restrictor so that, when the flush valve is open and water from the pressure chamber is discharged under pressure through the nozzles, a subsequent flushing cycle will be delayed until a predetermined line pressure builds up in the pressure chamber; a reservoir tank is connected to the bowl drain and is adapted to collect water from other utility stations until a predetermined quantity of liquid is present in the reservoir; control means are provided to discharge liquid from the reservoir to flush the drain conduit when the predetermined liquid level in the reservoir is reached.

5 Claims, 11 Drawing Figures

NOZZLE FLUSH SYSTEM

BACKGROUND OF THE INVENTION

This invention relates to a plumbing system for flushing a toilet bowl and, more particularly, to a system having a liquid flow control means for regulating the quantity of liquid utilized in flushing the toilet bowl.

Plumbing systems presently in use for flushing toilets commonly employ a reservoir tank which is connected to a bowl so that, upon initiating a flushing cycle, substantially all of the water in the reservoir is dumped into the bowl under gravity flow, that is, the flushing water is utilized without any appreciable pressure. In general, such systems utilize between three and five gallons of liquid for each flushing cycle. In other arrangements, instead of employing reservoir tanks, a manually actuated flushing valve is installed between a conduit containing liquid under pressure and the flushing pipe. Such flushing valves are generally of the type wherein, once opened, they are held open by mechanical delaying action before closing or are closable in response to a predetermined pressure drop. As a consequence, the quantity of liquid discharged through such a flushing valve is not significantly less than the quantity of liquid consumed where the reservoir type flushing system is employed. Additionally, flushing valves that are presently in use are capable of being continuously operated in much the same fashion as a faucet outlet, thus constituting a further source of water waste.

It is an object of the present invention to provide a flushing system wherein a substantially reduced quantity of liquid is required to efficiently operate the system and where a built-in delay mechanism is employed to prevent both continuous flushing as well as repeated, closely spaced restarting of the flushing cycle.

BRIEF SUMMARY OF THE INVENTION

In accordance with one embodiment of the present invention, high pressure liquid discharge nozzles which provide a well defined spray pattern are spaced about the rim of a toilet bowl so that the discharge from the nozzles will cover and flush the interior surface of the bowl. The nozzle means are all connected to a common pressure chamber through a conventional flush valve of the type which is manually openable and which closes in response to a pressure drop on the side of the valve that is connected to a liquid source such as a water main. Further, in accordance with one form of the present invention, a pressure chamber is provided with an outlet connected to the flushing valve and an inlet which is connected to flow restricting means which in turn is connected to a liquid source under pressure. The pressure chamber is provided with a dead air space so that, as the pressure chamber fills with liquid, the atmosphere of the dead air space will be compressed to a pressure approximately equal to that of the line pressure. As a result, when the flush valve is opened, a predetermined quantity of liquid will be discharged from the pressure chamber to the nozzles to flush the bowl. However, by virtue of the implementation of the flow restricting means at the inlet to the pressure chamber, a subsequent flushing cycle cannot be initiated until pressure builds up again in the pressure chamber.

In an alternate embodiment, which is useful, for example, where there are wide variations in the water pressure provided from the municipal water system, the flush valve can be of the electrically actuated solenoid type which is also provided with the dual electronic time delay mechanisms. One of the delay mechanisms would operate to regulate the period during which the flush valve remains open while the other time delay mechanism would prevent reactuation of the solenoid and thus opening of the flush valve for a predetermined time period to prohibit thereby too frequent reinitiations of the flushing cycle.

With the foregoing arrangements, the quantity of liquid required to efficiently flush the bowl can be substantially reduced since the amount of liquid used to flush the bowl is still delivered under sufficient pressure, i.e., substantially the main pressure, and the quantity of liquid available for each flushing cycle is regulated by the size of the pressure chamber or the time delay mechanism of the electric flush valve.

Another feature of the present invention which further contributes to the conservation of water resources resides in the utilization of an additional drain flush reservoir. In accordance with this invention, at a point closely adjacent to the bowl, in the drain conduit thereof, there is connected an additional conduit which in turn is connected to a reservoir tank which is adapted to receive drain water from other ulility stations such as the sink, baths and showers or even the roof drain gutters of a dwelling. In the tank reservoir, liquid level control means are employed so that, when a predetermined liquid level accumulates in the reservoir, a valve will be opened to discharge the reservoir's contents into the drain pipe of the toilet bowl. Use of such an arrangement will ensure that waste solids present in the drain line from the toilet bowl will be flushed to the main sewer line.

The apparatus of the present invention will permit substantially enhanced control of the liquid quantities needed for sanitary flushing of the toilet bowl and will also discourage indiscriminate waste of the water resources by preventing closely spaced initiation of flushing cycles.

DETAILED DESCRIPTION OF THE INVENTION

Figure 1:
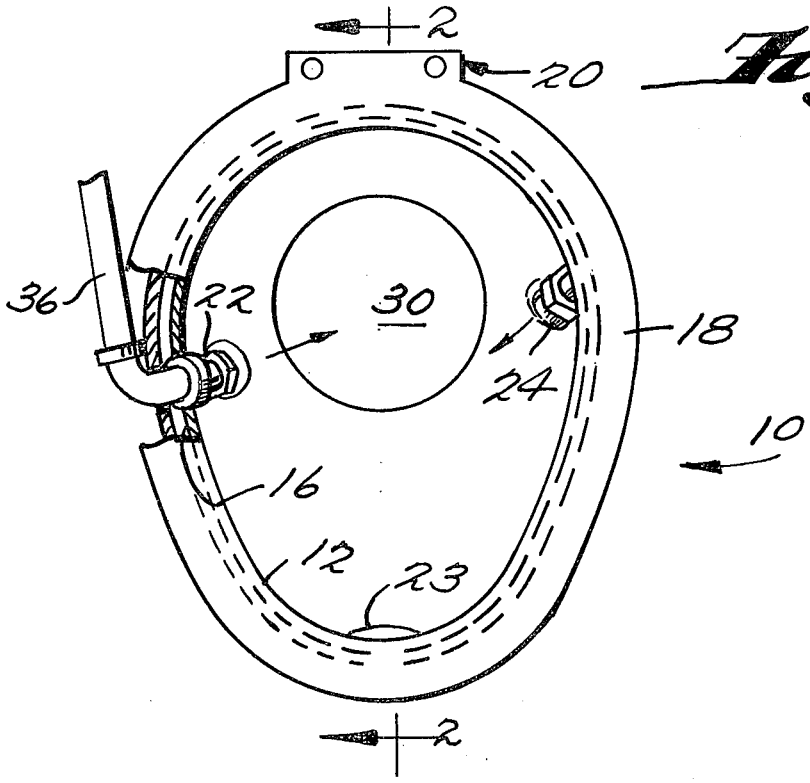
FIG. 1 is a top plan view with parts broken away illustrating one disposition of the nozzles of the plumbing system.

With reference now to the drawings, wherein like numerals designate corresponding parts throughout the several views, there is illustrated in FIG. 1 a plan view, with parts broken away, of a toilet bowl generally designated at 10 which has a generally horizontally disposed rim 12 which is surrounded by a flange 14. Flange 14 is set back or recessed from the rim 12 to provide space for a depending wall 16 of a toilet seat 18. The toilet seat 18 is fixed to a portion of the flange 14 at its rear portion by a hinge 20, as is more clearly shown in FIG. 2.

About the rim 12 of the bowl 10, there are located, as illustrated in FIG. 1, three nozzle means 22, 23 and 24. While three nozzles are preferred, it has been found that two can be utilized if they are properly positioned. Each of the nozzle means is provided with a specially designed nozzle head 32 (FIG. 2) which is adapted to discharge liquid in a well-defined spray pattern. By appropriately positioning the nozzle means 22, 23 and 24 about the rim 12 of the bowl 10, liquid distribution over the entire interior surface 28 of the bowl 10 can be assured so that all waste matter can be flushed through the drain outlet 30 of the bowl 10. Of course, the interior surface 28 of the bowl 10 may be of conventional design, that is, with smooth, steeply sloping sides.

Figure 2:
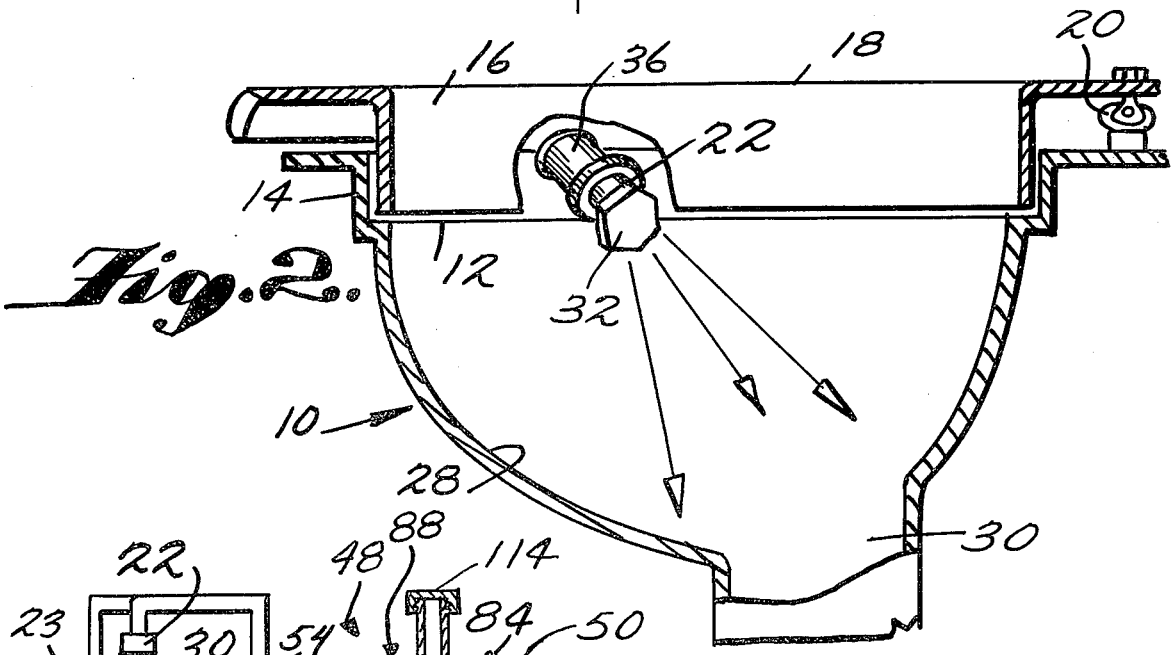
FIG. 2 is a sectional view taken along lines 2—2 of FIG. 1.
Figure 3:
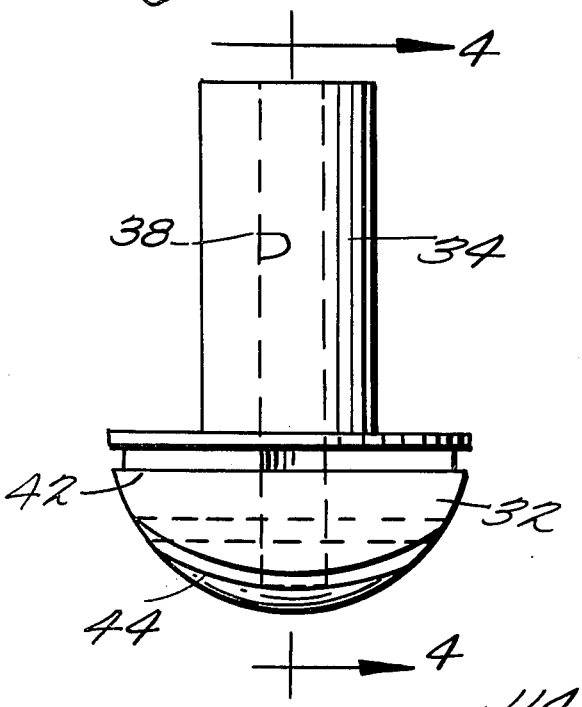
FIGS. 3 and 4 are sectional views of one embodiment of the pressure nozzles employed in the present invention.
Figure 4:
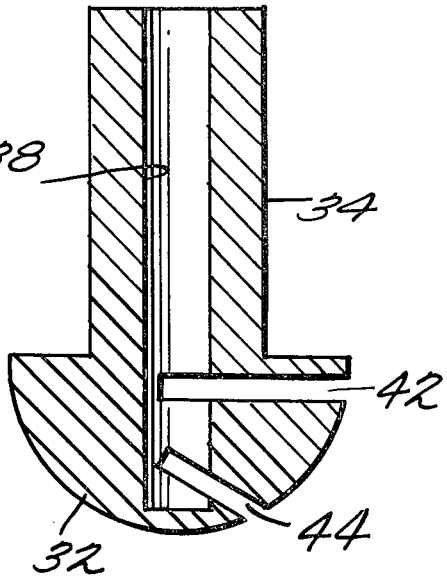

With reference now to FIGS. 3 and 4, there is illustrated a preferred design for the nozzle means 22, 23 and 24 which consists of a head 32 and shank 34 which is connected to or formed integrally with the head 32. A portion of the shank 34 may of course be threaded so that the nozzle means may be connected to the outlet of a fluid conduit 36 as shown in FIGS. 1 and 2. A flow passage 38 extends from the inlet 40 through the shank 34 and a major portion of the head 32. In the illustrated embodiment of the nozzle means, two outlets are provided in the form of very narrow slots 42 and 44, each of which extends over approximately one-half of the head 32. The cross-sectional areas of the outlets are smaller than the cross-sectional area of the inlet 40. The sharp decrease in the cross-sectional areas occurs, of course at the juncture of the slots 42 and 44 with the flow passage 38.

With the foregoing configuration of the nozzle means, when liquid is supplied thereto under a predetermined pressure, the spray pattern will take the form of a substantially flat, fan-like dispersion. That is to say, considering that the axis of the flow passage 38 is the theoretical point of origin of the spray pattern, it is a characteristic of the pattern of such nozzles that the thickness of the pattern measured generally parallel to the axis of the passage 38 is very small relative to its angular dispersion which is measured in a plane generally parallel to the plane of the respective slots. It will also be appreciated that by using nozzles of the illustrated embodiment, it will be relatively simple to flush down all the interior surfaces of the bowl 10 by appropriately orienting the respective nozzle means 22, 23 and 24. Also, for particular bowl applications, the angular sweep of the slots 42 and 44 and their relative positioning in each head 32 of the nozzle means can be appropriately designed so as to furnish the desired spray pattern for any bowl configuration and depth.

It has been found that nozzle designs as described above will produce a dispersed flat fan-pattern spray where the liquid is delivered under as low a pressure as 5 pounds per square inch. Hpwever, for most plumbing applications in metropolitan areas, it has been found that the municipal water systems supply water from about 35 psi to 60 psi. Where the liquid is delivered at approximately 40 psi to such nozzles, each nozzle will pass approximately 0.6 gallons per minute or 0.01 gallons per second. Thus, with a flush cycle period of from 2½ to 5 seconds, the quantity of liquid available to flush the system at 40 psi will range from 0.025 gallons to 0.05 gallons.

Figure 9:
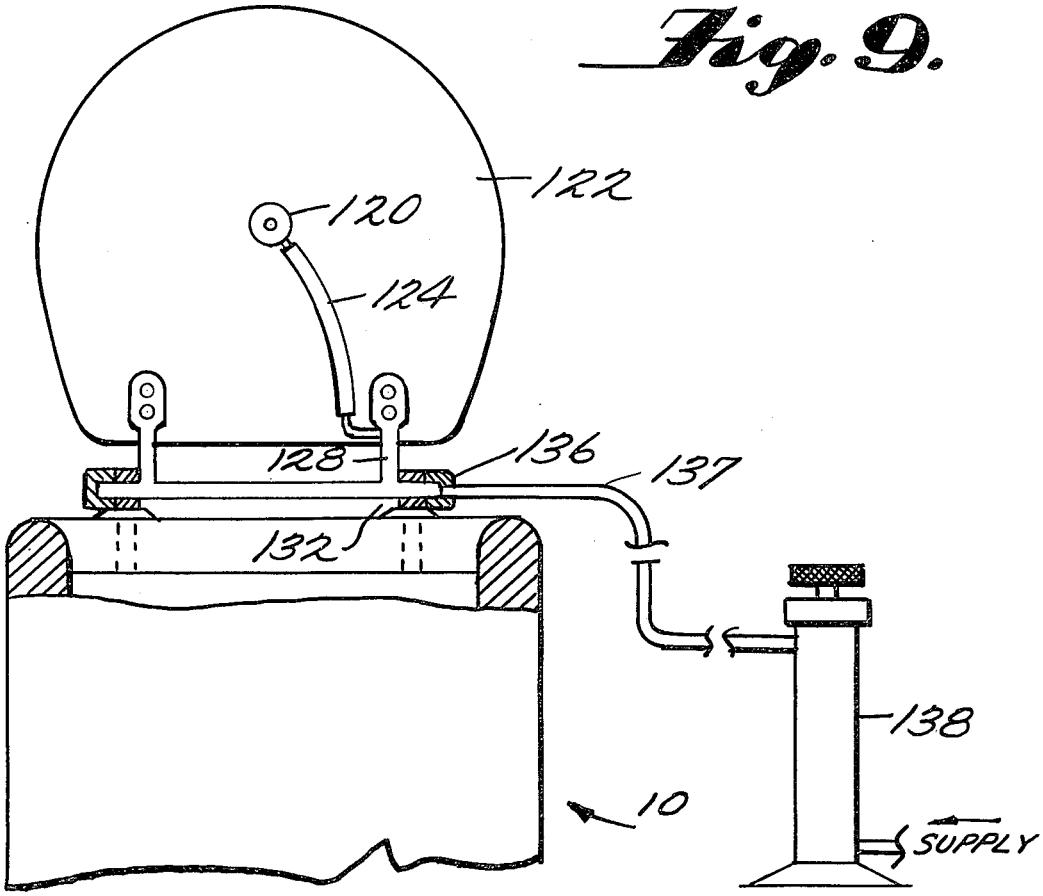
FIG. 9 is a front elevational view of an alternate embodiment of the present invention.
Figure 11:
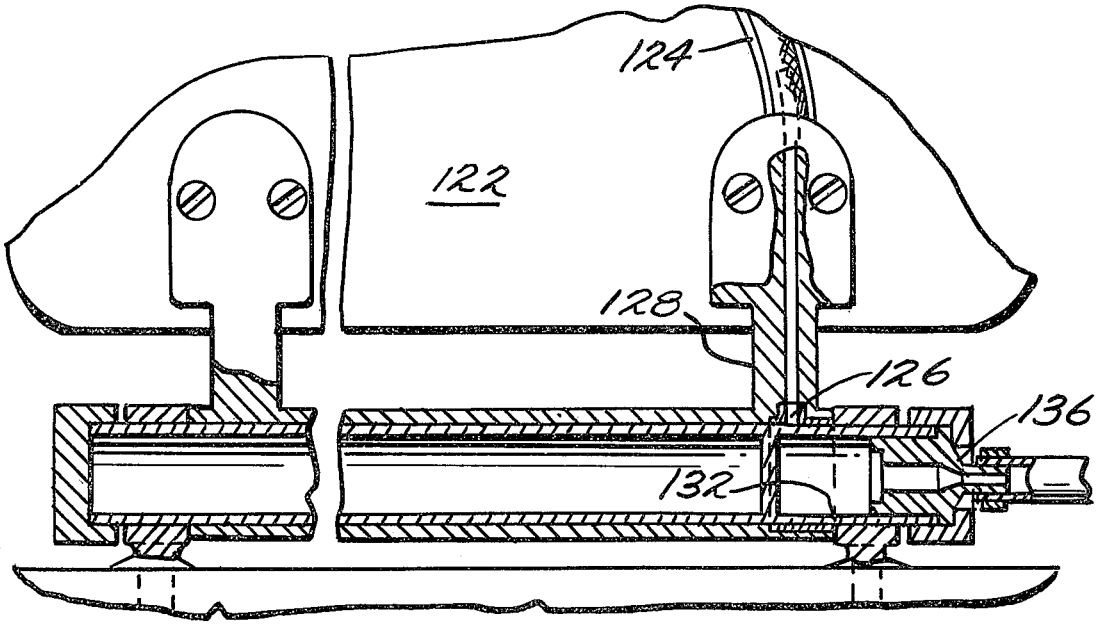
FIG. 11 is a rear detailed view with parts broken away of the embodiment of FIG. 9.
Figure 10:
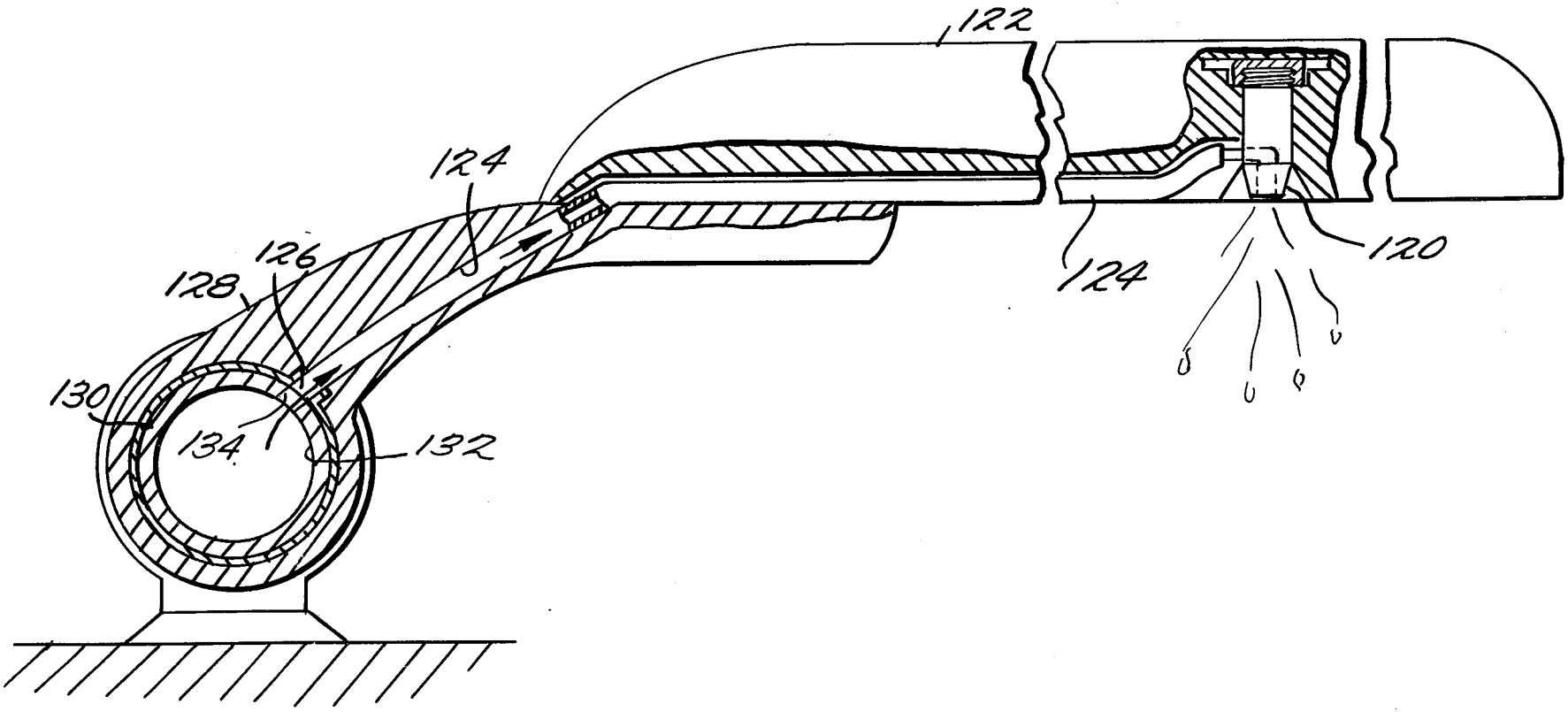
FIG. 10 is a side detailed view with parts broken away of the embodiment of FIG. 9.

With reference now to FIGS. 9, 10 and 11, there is illustrated an alternate embodiment having a nozzle 120 mounted on the underside of a toilet seat lid 122. The location of the nozzle 120 should be selected so that when the toilet seat lid is closed the spray pattern dispensed from the nozzle 120 will impinge on all areas of the toilet bowl 10. To accomplish this, the nozzle 120 should be of the type that dispenses liquid in a solid cone spray. Such types of nozzles are readily available on the market and provide a highly defined spray pattern that is well adapted to use with the present invention.

The nozzle 120 is connected by means of a hose 124 to flow control means in the form of a discharge port 126 (FIG. 10) which is formed in one of the hinge arms 128 which are utilized to secure the seat lid 122 to the top surface of the toilet bowl 10. In addition, the flow control means in the hinge arm 128 is provided with a hollowed out portion 130 in which is disposed a pivot tube 132 about which the hinge 128 is mounted for rotation. The hollow pivot tube 132 is provided with a discharge port 134 at a preselected position about its circumference so that discharge port 134 will be in alignment with discharge port 126 only when the seat lid is in the down-position as illustrated in FIG. 10.

As shown in FIG. 11, the end 136 of the hollow pivot tube 132 is connected by a suitable conduit 137 to a plumbing system for the purposes of supplying liquid to the nozzle 120. In FIG. 9, a hand pump 138 is shown with its outlet connected to conduit 137. The inlet to the pump is connected to a liquid reservoir. As will be apparent to those skilled in this art, suitable sealing means will be provided about the respective discharge ports 134 and 126 so that when the seat lid 122 is in the up-position corresponding to the discharge port 126 being rotated counterclockwise as viewed in FIG. 10 away from discharge port 134, passage of fluid through tube 124 will be prevented.

Figure 7:
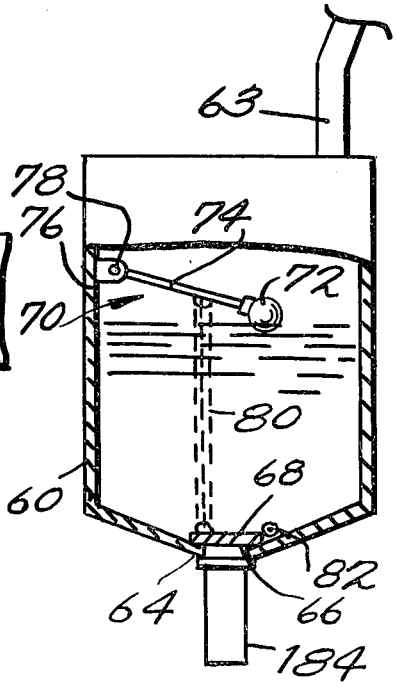
FIG. 7 is an elevational view, partly in section, of the reservoir tank and its level control means.

An important object of the present invention relates to the conservation of the water supply and one of the features of the present invention directed to this object will now be described in conjunction with FIGS. 5 and 7. The liquid flow control means is provided to permit the small quantities of liquid referred to above to be delivered to the nozzle means at substantially the water main pressure.

Figure 5:
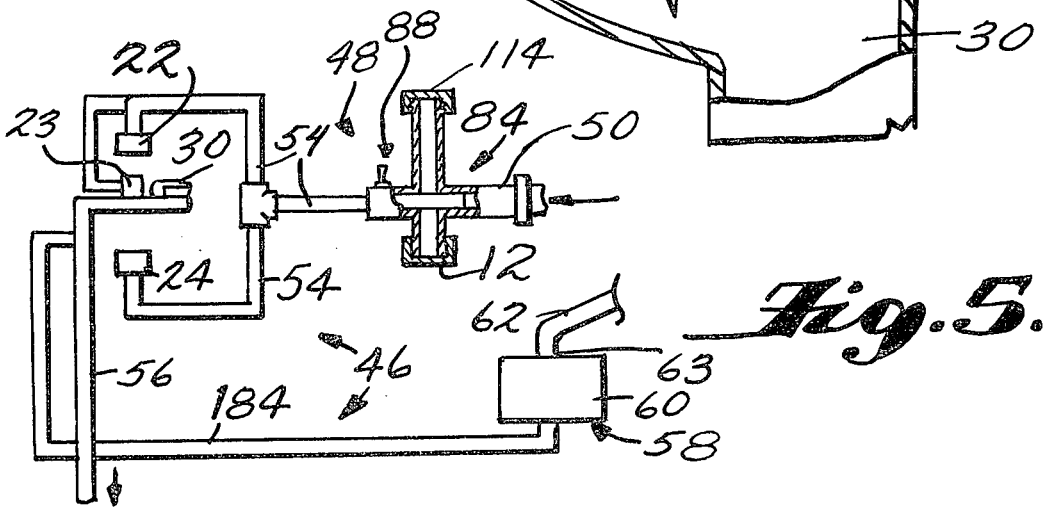
FIG. 5 is a schematic diagram of the plumbing system of the present invention.

In FIG. 5, there is schematically illustrated a plumbing system generally designated at 46. The plumbing system 46 includes a flow control means designated at 48 which has an inlet 50 connected to a source of liquid under pressure such as a water main. Flow control means 48 has an outlet 52 which is connected by pipes 54 to the nozzle means 22, 23 and 24. It will be understood, of course, that the distance between outlet 52 of the flow control means 48 and the nozzle means 22, 23 and 24 should be kept as small as possible to minimize any pressure loss between the flow control means and the nozzle means.

In the usual manner, the drain 30 of the bowl 10 is connected by pipe 56 to the main sewer line. In view of the fact that the object of the present invention is to utilize a substantially reduced quantity of liquid for the purpose of flushing the toilet bowl 10, the present invention provides an auxiliary flushing source 58 which includes a reservoir tank 60. Tank 60 is connected by pipes such as the one illustrated at 62 to the other water utility stations of a dwelling such as sinks, showers and laundry facilities. Thus, a fairly large supply of waste water will be supplied to the inlet 63 of the reservoir tank 60. At the bottom 64 of tank 60, an outlet 66 is provided which is closable by a hinged valve member 68. Liquid level regulating means 70 are provided in the form of a float 72 which is connected by an arm 74 to the sidewall 76 of the tank 60 by a pivot pin 78. The arm 74 is connected by a chain 80 to the upper face of the valve member 68 at a point opposite its hinge 82. It will be understood by those skilled in the art that the volume of the float 72 must be sufficient to overcome the weight of the liquid resting on the valve member 68 so that the valve member may be opened when the liquid level raises the float above a level determined by the length of the chain 80. Thereupon, the liquid contents of the tank 60 drain through pipe 184 which is connected to drainpipe 56 at a point closely adjacent to the drain outlet 30 of bowl 10 to thus provide a sufficient quantity of water to flush any solid waste materials to the main sewer drain. Of course, as is well known in the art, the liquid movement from the reservoir tank 60 to the point where the pipe 184 intercepts pipe 56 will be by gravity flow.

Figure 6:
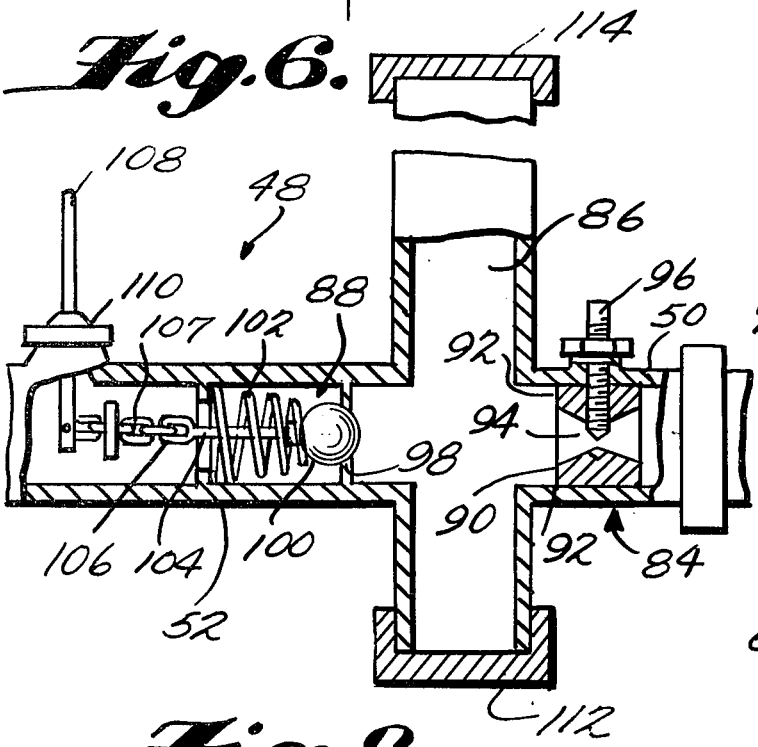
FIG. 6 is a sectional view and elevation of the flow control means.

The flow control means of the present invention will now be described in conjunction with FIGS. 5 and 6.

As previously described, the flow control means 48 of the present invention has its inlet 50 connected to a source of liquid under pressure such as a municipal water main and its outlet 52 connected to the nozzle means 22, 23 and 24. Intermediate the inlet 50 and the outlet 52, the flow control means 48 includes, in flow series, flow restricting means 84, a pressure chamber 86 and a flush valve 88.

The flow restricting means 84 preferably includes a blocking member 90 which may be secured in the inlet 50 by means of welding as at 92. Of course, other means of securing the blocking member 90 in place may be employed. The blocking member 90 is provided to block all flow into the pressure chamber 86 from the inlet 50 except through an orifice 94 which has a cross-sectional area substantially smaller than that of the inlet pipe 50. Additionally, the cross-sectional area of the inlet orifice may be made adjustable by the provision of a threaded screw member 96 which is adapted to traverse the orifice 94. Thus, a single flow restricting means can be employed for a wide variety of different pressure levels as are provided by the municipal water main.

Flush valve 88 includes a valve seat 98 of predetermined cross-sectional area, a ball valve member 100 which is formed to seat in the valve seat 98 to close the outlet flow passage 52. A resilient member such as spring 102 is provided to constantly urge the ball valve member against the valve seat 98. The spring constant of the spring 102 is chosen such that the ball valve 100 will remain closed up to a predetermined pressure level.

A stem 104 is connected to the ball valve 100 and extends backwardly away from the valve seat 98. The end 106 of the stem 104 is connected by a wire of chain 107 to one end of a lever 108. The lever 108 is adapted to pivot in a sealed receptacle 110 to thereby pull the ball valve member 100 off of seat 98 against the force of spring 102. Thereupon liquid in the pressure chamber 86 will flow past the valve until the force of spring 102 overcomes the action of the water pressure as the pressure drops and thereupon moves the ball valve 100 to close against valve seat 98. As is well known, means (not shown) may be provided for adjusting the force exerted by spring 102 on ball valve member 100 to accommodate different main pressures and vary the time valve 88 remains open in a flushing cycle.

Pressure chamber 86, which should be located vertically above the flow line defined by the inlet 50 and the nozzles, is in the form of a pipe section having sealed closed ends 112 and 114. The longitudinal axis of chamber 86 extends vertically and will have a pre-selected volume capacity. When in use, the upper end 114 of pressure chamber 86 contains a dead air space, the air of which will be compressed when valve 88 is closed and water from the municipal main flows into the pressure chamber through inlet 50 and the flow restricting means 84. In selecting the volume of chamber 86, allowance must be made for the volume of the compressed air, the amount of liquid required to flush the bowl 10 and the main pressure of the municipal water system.

By selecting the cross-sectional area of the valve seat 98 such that it is several times larger than the cross-sectional area of the orifice 94, it will be seen that the predominant pressure source functioning to force liquid in the pressure chamber out of the pressure chamber through flush valve 88 will be that of the compressed air in the upper portion of the pressure chamber 86.

In operation, assuming flush valve 88 is closed, water will flow into the pressure chamber 86 to a level such that the air in the upper portion of the chamber i6 is compressed to a pressure equal to that of the line pressure of the municipal water system. When flush valve 88 is opened, the compressed air will expand to force the water in the pressure chamber 86 out through the flush valve 88 and then to the nozzle means 22, 23 and 24. As liquid is being discharged from the pressure chamber 86, the pressure therein will drop thus permitting the action of spring 102 to force the ball valve 100 back against the valve seat 98 to close same. Water from the main will, of course, constantly be flowing through the inlet 50 and orifice 94 into the pressure chamber but due to the reduced size of the orifice 94 relative to the size of the valve seat 98, valve 88 will close before any appreciable accumulation of water in pressure chamber 86 can be effected. However, as previously noted, with valve 88 closed, pressure chamber 86 will refill until the water and air space in pressure chamber 86 are substantially under the main pressure.

It will be appreciated that since a predetermined pressure level is required in order for the nozzle means to effect the desired spray pattern, a closely time-spaced reopening of the flush valve 88 will not result in appreciable discharge of water through the nozzles until a predetermined pressure level has built up in the pressure chamber 86. That is to say, actuation of the flush valve 88 prematurely will discharge only a small quantity of liquid, usually in the form of a dribble, from the nozzle means and will further delay the necessary pressure build-up in the chamber 86.

With the apparatus as described above, very accurate control of the quantity of liquid used to flush a toilet bowl is possible thereby achieving a reduction in the quantity of water needed to sufficiently cleanse the bowl for each flushing cycle.

It will be understood by those skilled in the art that the volume of pressure chamber 86 may be made variable to accommodate different water pressures provided by a municipal water system, and that other types of flush valves may be substituted provided that they are of the type that automatically close upon sensing a drop in pressure.

Figure 8:
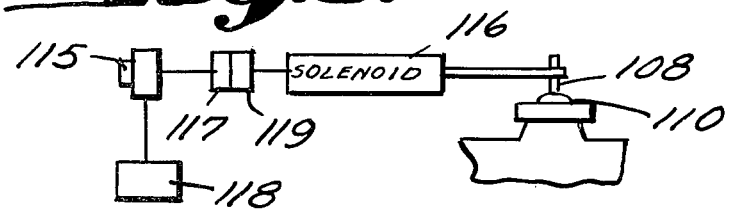
FIG. 8 is a schematic illustration of an electronic control device for use in the present invention.

By way of example, an electrically actuated solenoid flush valve may be employed as is schematically shown in FIG. 8, where there are wide variations in the line pressure from the water source or where a presently installed plumbing system does not permit installation of the above described pressure chamber. Preferably, the solenoid type valve would be of the conventional type wherein a switch 115 would be operated to supply current from a source 118 to a coil 116 which in turn would set up a magnetic field resulting in force being imparted to a core member. Movement of the core member would be directly linked to valve member 108 such as disclosed in FIG. 6 except that no pressure chamber 86 or flow restricting means 84 would be required. Instead, an electronic time delay circuit 117 would be employed to automatically cut off current to the solenoid after a predetermined time interval on the order of 2½ to 5 seconds. In addition, a second electronic time delay circuit 119 would be employed to prevent current being supplied to the solenoid for another predetermined period of time such as 1 to 2 minutes, to prevent repeated actuation, in a closely spaced sequence, of the flushing cycle.

It will be understood that the apparatus of the present invention is capable of various modifications. For example, the drain 30 of the bowl 10 is preferably provided with a closer as in the form of a gate valve which would only be open when the bowl is being employed. With such an arrangement, it will not be necessary to employ a water trap as is conventional, since such water traps require a great quantity of liquid for sanitary flushing whereas a straight drain conduit requires substantially less liquid.

A number of different types of high pressure nozzles is available on the market and can be usefully employed in the plumbing system of the present invention. In particular, as previously noted, solid cone nozzles provide a well defined spray pattern thus enabling them to be accurately positioned and aimed to efficiently and cleanly flush a bowl. Other types of nozzles will be apparent to those skilled in the art.

Frequently in the field of transportation such as in the case of mobile home, airplane and passenger railroad facilities, it is not possible to provide liquid under pressure to a nozzle flush system as is contemplated by the present invention. In such circumstances, it is obviously important to provide facilities which utilize as little liquid as possible to accomplish the flushing function so as to be able to minimize the quantity of flushing liquid that need be transported with the sanitary facility.

The present invention is particularly adapted to meet this need since the quantity of liquid required to obtain adequate flushing of a toilet bowl is substantially reduced by the use of the high pressure nozzles. Thus, where it is not possible to connect a plumbing system to a source of liquid under pressure, the high-pressure nozzles of the present invention can still be employed since a manual hand pump, such as is shown in FIG. 9 at 138 can be substituted to provide adequate pressure to the nozzles to thus provide the spray pattern required to flush down the interior of the bowl. Such hand pumps are commercially available and can be readily attached in the plumbing system of the present invention such as by connecting the inlet of the pump to a liquid reservoir and the outlet of the pump directly to the conduits leading to the flush nozzle or nozzles. The quantity of liquid available for a single flushing cycle is readily regulated by the liquid displacement capacity of the hand pump which thus constitutes a means for regulating the amount of liquid to be used in a flushing cycle.

Various other modifications will be apparent to those skilled in the art and may be utilized without departing from the invention as is commensurate with the appended claims.

What is claimed is:

1. Apparatus for flushing a toilet bowl of the type having a substantially horizontally disposed rim, a drain outlet located vertically below said rim and a smooth interior surface between said rim and drain outlet, said apparatus comprising in combination: liquid nozzle means having an inlet and an outlet, said nozzle means being disposed adjacent the rim of said bowl so that liquid discharged from said nozzle means will impinge upon all portions of the interior surface of said bowl, manually operable liquid flow control means including an outlet, conduit means for connecting said control means outlet to said inlet of said nozzle means, said flow control means having a flow passage of predetermined cross-sectional area and valve means for closing said flow passage, said valve means being manually movable to open said flow passage and movable to close said flow passage in response to a drop in pressure in said flow passage, said control means including a pressure chamber, an inlet connecting said pressure chamber to a source of liquid under pressure, and means for restricting the flow of liquid from the source to said pressure chamber so that, when said valve means is moved to open said flow passage, a predetermined quantity of liquid will discharge from said pressure chamber to said nozzle means causing a pressure drop sufficient to result in the closing of said flow passage by said valve means before pressure in said pressure chamber is restored by flow from the liquid source, said means for restricting the flow of liquid from the liquid source to said pressure chamber comprises an inlet orifice having one side communicating directly with said liquid source and its other side communicating directly with said pressure chamber, said means connecting said pressure chamber to the liquid source having a predetermined cross-sectional area and said pressure chamber having a predetermined cross-sectional area, said inlet orifice having a cross-sectional area that is substantially dimensionally smaller than said predetermined cross-sectional areas of said pressure chamber and said means connecting said pressure chamber to the liquid source, said inlet orifice including means for adjusting the cross-sectional area thereof to vary the rate of liquid flow therethrough, said pressure chamber having a vertical axis, an upper end portion and a lower end portion, said means connecting said pressure chamber to a source of liquid under pressure comprising an inlet located between said upper and lower end portions, and said inlet of said flush valve being connected to said lower end portion of said pressure chamber so that, when said pressure chamber is filling with liquid, any atmospheric gases in said pressure chamber will be compressed in said upper end portion thereof to a pressure substantially equal to the pressure of said liquid source.

2. The apparatus as claimed in claim 1 wherein said valve means comprises a valve seat in said flow passage, a valve member, resilient means for constantly urging said valve member against said valve seat and manually operable means for moving said valve member off of said valve seat against the force of said resilient means.

3. In the apparatus as claimed in claim 1 wherein the drain outlet of the toilet bowl is connected to a pipe which drains to a sewer line, the apparatus further including a liquid tank reservoir having an outlet connected by conduit means to said pipe for establishing gravity flow of liquid from said tank reservoir to said pipe, means for supplying liquid to said tank reservoir, valve means for opening and closing said outlet of said tank reservoir, level regulating means for opening said valve means of said tank reservoir in response to the presence of a first pre-selected liquid level in said tank reservoir and for closing said valve means of said tank reservoir in response to the presence of a second pre-selected liquid level in said tank reservoir with said second liquid level being lower than said first liquid level.

4. The apparatus as claimed in claim 3 wherein said means for supplying liquid to said tank reservoir is a drain conduit connectable to other liquid utility stations.

5. Apparatus for flushing the toilet bowl of the type having a substantially horizontally disposed rim, a drain outlet located vertically below said rim and a smooth interior surface between said rim and drain outlet, said apparatus comprising in combination:

at least two liquid nozzle means each having an inlet and an outlet, said inlet having a cross-sectional area that is larger than the cross-sectional area of said outlet, a passage between said inlet and outlet, said passage having a cross-sectional area that decreases in size between said inlet and said outlet, means for supplying liquid under a predetermined pressure to said nozzle means, said nozzle means being disposed adjacent the rim of said bowl so that liquid discharged under a predetermined pressure from said nozzle means will impinge upon all portions of the interior surface of said bowl, manually operable liquid flow control means including an outlet connected by conduit means to said inlets of said nozzle means, said flow control means having flow passage, said flow passage having a valve seat therein, and an inlet connected to a source of liquid under pressure, a solenoid, a valve member connected to said solenoid and means for supplying current to said solenoid whereby said solenoid will move said valve member to open said flow passage, first circuit means for cutting off current to said solenoid after a first predetermined time period and second circuit means for preventing current from being supplied to said solenoid for a second predetermined period of time.

* * * * *